US007898410B2

(12) United States Patent
Schurter

(10) Patent No.: US 7,898,410 B2
(45) Date of Patent: Mar. 1, 2011

(54) FIREFIGHTER RESPONSE SYSTEM

(75) Inventor: Craig Schurter, Salem, OR (US)

(73) Assignee: Advanced First Responder Solutions, LLC, Salem, OR (US)

( * ) Notice: Subject to any disclaimer, the term of this patent is extended or adjusted under 35 U.S.C. 154(b) by 229 days.

(21) Appl. No.: 11/840,160

(22) Filed: Aug. 16, 2007

(65) Prior Publication Data

US 2009/0045942 A1 Feb. 19, 2009

(51) Int. Cl.
*G08B 1/08* (2006.01)

(52) U.S. Cl. ..... 340/539.18; 340/539.11; 340/539.16; 340/539.19; 340/286.06; 340/286.05; 705/7; 705/9

(58) Field of Classification Search ..... 340/505–506, 340/525, 539.11, 539.13, 539.18, 10.1, 10.3, 340/539.19, 285.05, 285.06; 705/7, 9
See application file for complete search history.

(56) References Cited

U.S. PATENT DOCUMENTS 3,864,674 A * 2/1975 Worsham et al. ..... 340/530
5,162,776 A * 11/1992 Bushnell et al. ..... 340/501
5,414,408 A * 5/1995 Berra ..... 340/525
5,793,882 A 8/1998 Piatek et al.
6,917,288 B2 * 7/2005 Kimmel et al. ..... 340/511
6,998,978 B2 * 2/2006 Kirkeby ..... 340/539.12
7,047,114 B1 * 5/2006 Rogers ..... 701/21
7,091,852 B2 * 8/2006 Mason et al. ..... 340/539.13
7,245,216 B2 * 7/2007 Burkley et al. ..... 340/539.13
7,251,312 B2 * 7/2007 D'Evelyn et al. ..... 379/45
7,271,704 B2 * 9/2007 McSheffrey et al. ... 340/286.05
7,298,276 B2 * 11/2007 Perez Garcia ..... 340/573.1
7,323,980 B2 * 1/2008 Faulkner et al. ..... 340/521
7,355,507 B2 * 4/2008 Binning ..... 340/332
7,538,666 B2 * 5/2009 Campman ..... 340/539.13
7,633,387 B2 * 12/2009 Carmichael et al. .... 340/539.13
7,746,794 B2 * 6/2010 Sink ..... 370/245
2004/0192353 A1 * 9/2004 Mason et al. ..... 455/457
2007/0083409 A1 * 4/2007 Dilbeck et al. ..... 705/7
2007/0103294 A1 * 5/2007 Bonecutter et al. ..... 340/539.18
2008/0175356 A1 * 7/2008 Seidberg et al. ..... 379/45
2008/0192731 A1 * 8/2008 Dickinson ..... 370/352

OTHER PUBLICATIONS

IAM Technologies, "Brochure & Pricing distributed at Feb. 24-25, 2007 Finger Lakes Conference," 6 pages.
IAM Technologies, "Apr. 5, 2007 Screen Shots of live, functional system at http://www.iamresponding.com," 28 pages.
IAM Technologies, "Original PowerPoint slide show from www.iamresponding.com, showing primary system functionality," 12 pages, 2007.
IAM Technologies, Brochure and Pricing distributed at May 16-19, 2007 Harrisburg Fire Expo, 6 pages.
IAM Technologies, "May 21, 2007 email blast by Chief Goldfeder," 2 pages.
IAM Technologies, "May 21, 2007 Email blast from Pennsylvania State Fire Commissioner Ed Mann," 2 pages.
IAM Technologies, "Jun. 2007 New York Chiefs Show pre-show mailing," 2 pages.
IAM Technologies, "Jul. 2007 Innovation Award Press Release," 3 pages.

* cited by examiner

*Primary Examiner*—George A Bugg
*Assistant Examiner*—Son M Tang
(74) *Attorney, Agent, or Firm*—Alleman Hall McCoy Russell & Tuttle LLP

(57) ABSTRACT

A method for identifying available resources for responding to an incident is provided. The method includes receiving a communication from each of a plurality of first responders, where the communication is responsive to an incident generated request, processing each of the communications to generate a response status for each of the plurality of first responders, and sending the response status for each of the plurality of first responders to a remote program.

25 Claims, 10 Drawing Sheets

FIREFIGHTER RESPONSE SYSTEM

BACKGROUND AND SUMMARY

Fire departments may utilize a combination of full-time firefighters and volunteers to aid in responding to an emergency. Moreover, in many communities volunteer firefighters may be relied upon solely to be first responders during an emergency. For example, in areas with small populations a full-time fire department may not be viable due to cost restrictions, thus emergency response duties may be performed entirely by volunteers.

In the event of an emergency a volunteer firefighter may be informed of the emergency by dispatch. Further, dispatch may request that the volunteer firefighter respond to the emergency. If the volunteer firefighter is available and able, he/she may be expected to respond to the emergency, either by proceeding to a designated fire station or directly to the location of the emergency.

However, for various reasons volunteer firefighters and other first responders may not be able to respond to an incident. This may create numerous communication and logistical obstacles for department personnel, field command, dispatch, and the volunteer firefighters to overcome. One obstacle field commanders or emergency response directors may face is being uninformed of how many volunteer firefighters and first responders are responding to the emergency. By not knowing how many individuals are responding to the emergency, a field commander or emergency response director may be unable to discern if a suitable amount of resources is available to properly handle the emergency.

Another obstacle field commanders or emergency response directors may face is being uninformed of who is responding to the emergency and what type of equipment is being transported to the emergency. It may be appreciated that various individuals in each unit may have different skills or specialties that may be applicable to specific types of emergencies and different types of equipment may be necessary to handle specific emergencies. By not knowing which individuals are responding and what equipment is being transported to the emergency, a field commander or emergency response director may be unable to discern if the available resources may be suitable to handle the emergency.

Further, one obstacle volunteer firefighters may face is not being informed of how many other volunteers are responding to the station with them. When a volunteer firefighter is alerted of an emergency by dispatch, if they are able, they may respond to the fire station to pick up an emergency apparatus (e.g. a fire engine). When they arrive, they may be the first volunteer firefighter or the last volunteer firefighter to arrive. Both situations pose obstacles. For example, if they are the first volunteer firefighter to arrive at the fire station, they need to make a decision whether to go in route with the emergency apparatus or to wait for other volunteer firefighters to arrive. If they choose to wait they must choose how long to wait before leaving the fire station to respond to the emergency. By not knowing how may other volunteer firefighters are responding, firefighters at the station may squander valuable time waiting for other volunteer firefighters that may or may not be responding to the emergency.

Furthermore, if the volunteer firefighter is the last to arrive at the fire station, the volunteer firefighters that arrived previously may make the decision to leave the fire station and respond to the emergency with the emergency apparatus. By not knowing how many volunteer firefighters are responding, the volunteer firefighters at the fire station may respond without having a full crew to handle the emergency.

At least some of the above issues may be addressed by a method for identifying available resources for responding to an incident. The method may comprise receiving a communication from each of a plurality of incident first responders, where the communication is responsive to an incident generated request. Further, each of the communications may be processed to generate a response status for each of the plurality of first responders. Finally, the response status for each of the plurality of first responders may be sent to a remote program. Such an approach may enable improved management of personnel and/or resources using the response status, especially for the example where the first responders include volunteer firefighters.

BRIEF DESCRIPTION OF THE FIGURES

The disclosure is illustrated by way of example and not by way of limitation in the figures of the accompanying drawings, in which the like references indicate similar elements and in which.

DETAILED DESCRIPTION

The incident response system described herein may provide improved communication and information distribution between first responders, emergency departments and dispatch during response to an incident. For example, the system may be used for management of first responders, such as firefighters, including volunteer firefighters, EMS workers, etc., during a particular emergency response. In particular, the incident response system may catalogue firefighter resources and may show how many firefighters are responding to the incident and which firefighters are responding to the incident.

The incident response system may also act as an accountability system that may list all available first responders at any given time. The response information may be generated from communications of first responders to requests for response and the generated response information may be dispersed in real-time to various incident response units (e.g., stations, departments, etc.) in different locations. The incident response system may display response status information that may be used as a decision-making tool that can be used "in-station" for first responders, in the field by department command personnel, and by dispatch as well as to provide a high-level perspective of the response effort for response evaluation purposes. The incident response system may be particularly applicable in communities that rely solely on their combination (paid and volunteer staff) or all volunteer fire, rescue, and emergency medical technician (EMT) departments.

The incident response system may be applicable to volunteer firefighter and emergency rescue applications where responders may be spread across a large region and may respond to a fire station or directly to the location of an incident from different locations at different times. In such an application, real-time incident response information may be beneficial for organizing and directing the response effort to the incident.

Figure 1:
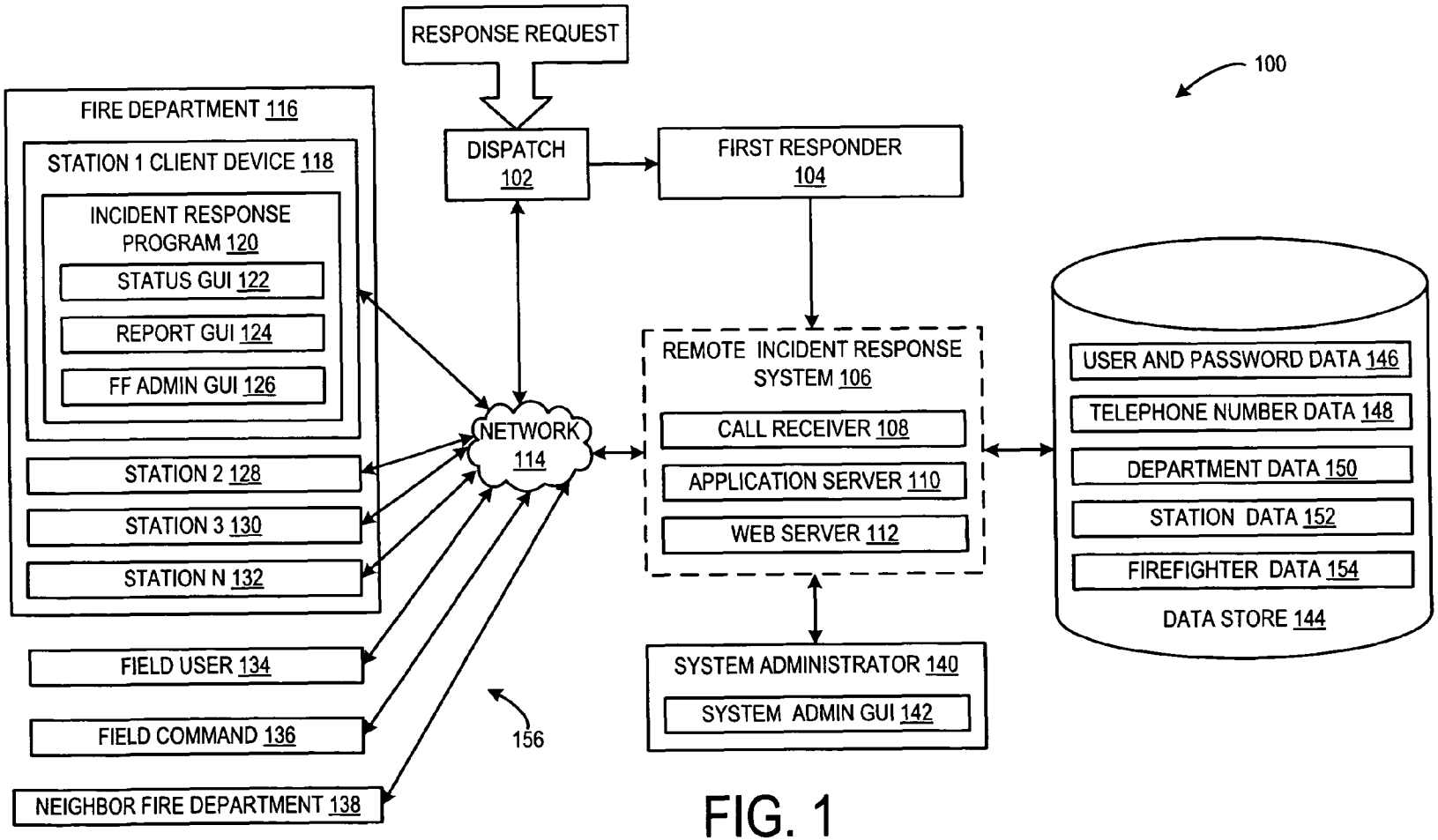
FIG. 1 depicts a schematic diagram of an example embodiment of an incident response system.

FIG. 1 illustrates an exemplary embodiment of an incident response system 100, which in one example may represent a firefighter response system. Incident response system 100 may include dispatch 102, which may receive requests to respond to various incidents. In some cases, the incident may be an emergency event, which requires immediate response. Accordingly, dispatch 102 may send a response request to one or more first responders 104. The response request may include various amounts of information relating to the incident, such as the nature of the incident (potentially communicated via an emergency response code number), location of the incident, time of occurrence, etc. On the other hand, the response request may only include a single request phrase or a phone number to which the first responder may reply, for example the first responder may receive a text-based page with a particular telephone number or other request message.

Furthermore, the response request may be sent in one or more different formats, such as for example, a telephone call (or message), page request (e.g. tone pager), text-based message, etc. The response request may be sent to one or more devices (or locations) associated with first responder 104 in order to increase the likelihood of the first responder receiving the response request. In one particular example, dispatch may send a response request to a volunteer firefighter at a work telephone number, a home telephone number, over a tone pager, and/or a cellular telephone number associated with the volunteer firefighter. In the illustrated embodiment, it will be appreciated that first responder 104 may include one or more electronic communication devices associated with an individual who may respond to an incident, such as for example, a volunteer firefighter.

Figure 8:
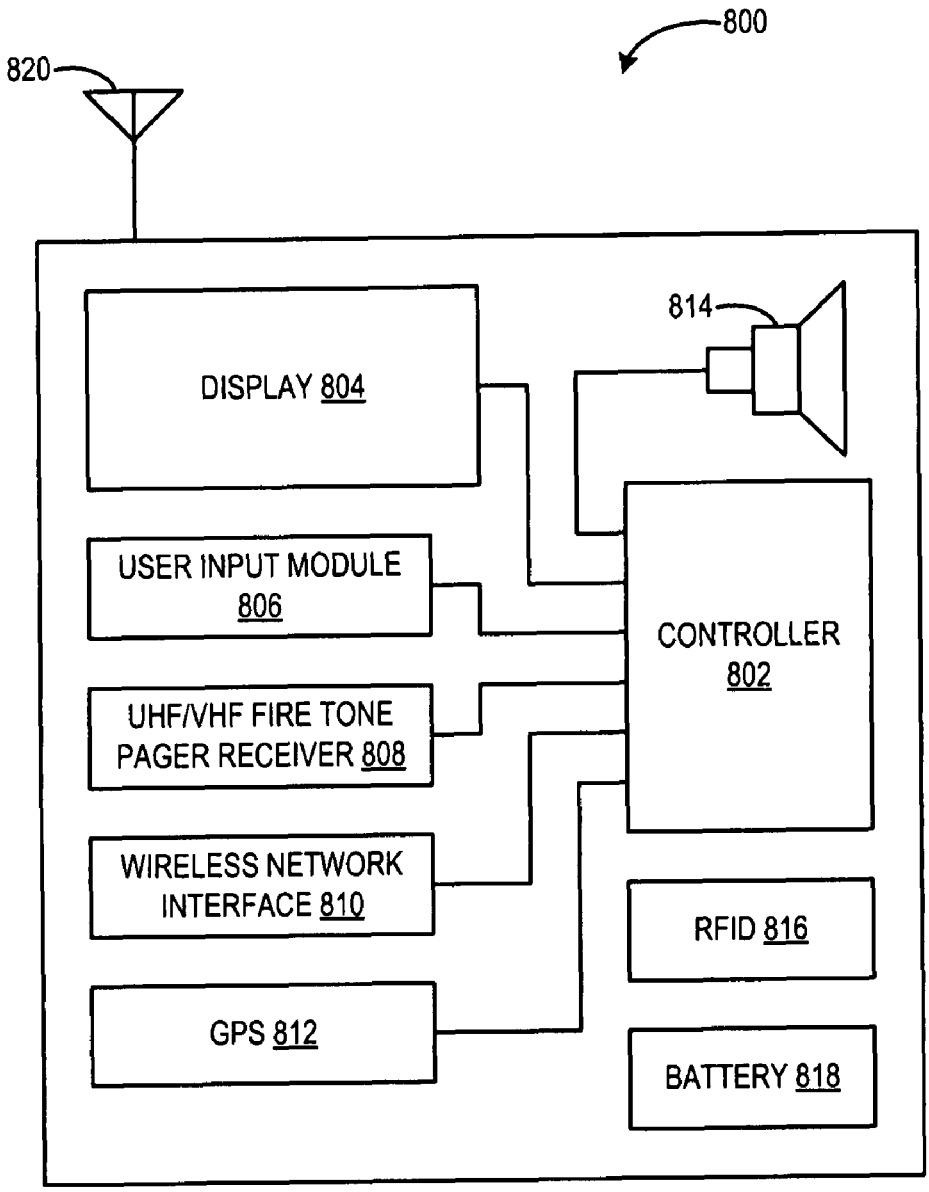
FIG. 8 depicts a schematic diagram of an example client device that may be used by a first responder in the system of FIG. 1, for example.

Note that various devices may be used by a first responder to respond to an incident. For example, FIG. 8 depicts a schematic diagram of an example embodiment of an electronic communication device that may be used by a first responder to respond to an incident.

Returning now to FIG. 1, upon receiving the response request, the first responder may reply to the response request either in station or remotely if they are on duty and/or if they are able to respond to the incident. The first responder may reply to the request in order to communicate that they will respond to the incident. Accordingly, first responder 104 may send a communication to remote incident response system 106. Remote incident response system 106 may include call receiver 108 to direct incoming communications from first responders. In one example, each department station (e.g. fire & rescue, EMT, etc.) included in the incident response system may be assigned a unique and dedicated telephone number which, if a first responder is responding to a request for help from dispatch, may call to record their response for department commanders, other responders, and dispatch to view. In another example, the first responder may respond via a text-based message, telephone or email. As yet another example, the first responder may send responding communication via a push-to-talk message (e.g. walkie-talkie, "Direct Connect", etc.)

It will be appreciated that in some embodiments remote incident response system 106 may be an application service provider that provides computer-based services to participating entities (e.g. fire departments, fire stations, dispatch, etc.) over a network. In particular, among other features, remote incident response system 106 may process incoming communications from a plurality of first responders and may grant access to an incident response program 120 where the participating entities may view incident response information generated from the processed communications.

In some embodiments, call receiver 108 may include a private branch exchange (PBX), which may be implemented on an integrated services digital network (ISDN). In some embodiments, call receiver 108 may be implemented on a public switched telephone network (PSTN) that employs plain old telephone services (POTS). In some embodiments, call receiver 108 may include a voice over internet protocol (VoIP) switch that may direct incoming calls. In some embodiments, a push email (e.g. POP3) service may be included in remote incidence response system for directing text-based messages from first responders. Further, it will be appreciated that in some embodiments, call receiver 108 may be implemented using a combination of the above described telephony and messaging systems. Although the call receiver is depicted as being integrated with remote incident response system 106 it will be appreciated that in some embodiments call receiver 108 may be implemented independent of remote incident response system 106.

Upon receiving an incoming communication (e.g. telephone call), the remote incident response system 106 may attempt to recognize a communication identifier (e.g. a telephone number of the caller) in order to identify the first responder and to direct the telephone call appropriately. In particular, data store 144 may include telephone number data 148, which may represent telephone numbers associated with each first responder. Application server 110 may compare the telephone number of the caller to telephone number data 148 retrieved from data store 144 in order to identify the first responder. If remote incident response system 106 does not recognize the incoming telephone number, the system may prompt the first responder to manually enter an identification code that identifies the first responder (e.g. the caller's cellular telephone number, work telephone number, home telephone number, etc.). In some embodiments, the communication identifier may include a unique pin number that may be assigned to each first responder and the remote incident response system may prompt the first responder to enter the unique pin number as part of the communication in order to identify the first responder.

In some embodiments, first responders may be associated with multiple response units (alternately referred to as departments and/or stations), and thus, the remote incident response system 106 may identify the response unit that the first responder is attempting to contact based on a communication identifier (e.g. a dialed telephone number). In particular, application server 110 may compare the dialed telephone number to telephone number data 148 retrieved from data store 144 in order to identify the response unit.

Once remote incident response system 106 has identified the first responder and the response unit, the call may be automatically disconnected or directed to the call receiver 108 and the system may present incident information to the first responder. In one embodiment, call receiver 108 and/or application server 110 may automatically disconnect the first responder once their identity has been confirmed via data in data store 144 and their response status has been recorded. In another embodiment, call receiver 108 and/or application server 110 may present information to the first responder in an automated manner to realize whether or not the first responder intends to respond to the incident. In yet another embodiment, call receiver 108 may direct the first responder to an actual person who may present the information to the first responder. The presented information may be brief, such as a single question of whether the first responder is responding. On the other hand, the presented information may include additional information relating to the incident such as location or time of occurrence, for example.

In some embodiments, first responders may reply to requests generated in response to incidents in order to communicate whether or not they intend to respond to the incident. For example, dispatch may send a general message to all first responders regardless of the status of the first responders (e.g. on duty/not on duty, active, etc.) and the first responders may send a communication that includes whether or not they are responding to the incident. In such an embodiment, in one particular example, a first responder may call the designated telephone number and may be prompted by the remote incident response system 106 to press a single designated key on the telephone keypad to indicate whether or not they are responding to the incident. For example, the first responder may press "1" for "YES" and "2" for "NO". Further, the remote incident response system may record and assess the first responder input and may generate a confirmation response (e.g. tone or phrase) to indicate to the first responder that the entry has been properly recorded. As another example, the first responders may communicate their response intentions to a dispatcher who may enter the first responder's response status into the remote incident response system 106.

Furthermore, application server 110 may be configured to record information related to the telephone call which may be assessed by remote incident response system 106. In one example, application server 110 may record the telephone number to which the telephone call is directed, the telephone number from which the incoming telephone call was placed, a time and date stamp of the telephone call, and input (e.g. spoken word or keypad entry) entered by the first responder during the course of the telephone call. Recorded information may be stored in application server 110 and/or data store 144. Processing of first responder communications by the remote incident response system 106 will be discussed in further detail below with reference to FIGS. 6 and 7.

Figure 2A:
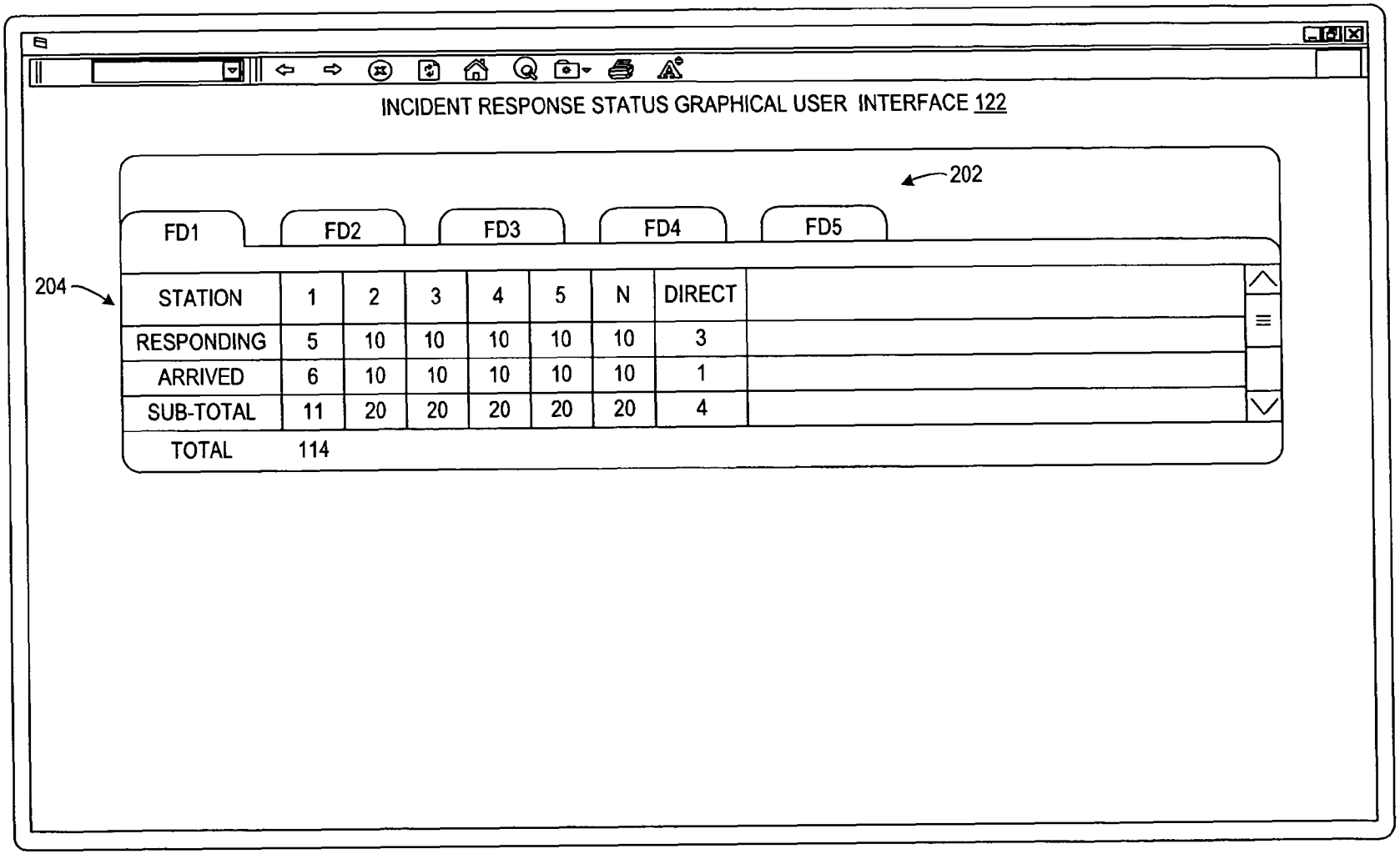
FIGS. 2A and 2B illustrate an example graphical user interface presenting a status of response to an incident.
Figure 2B:
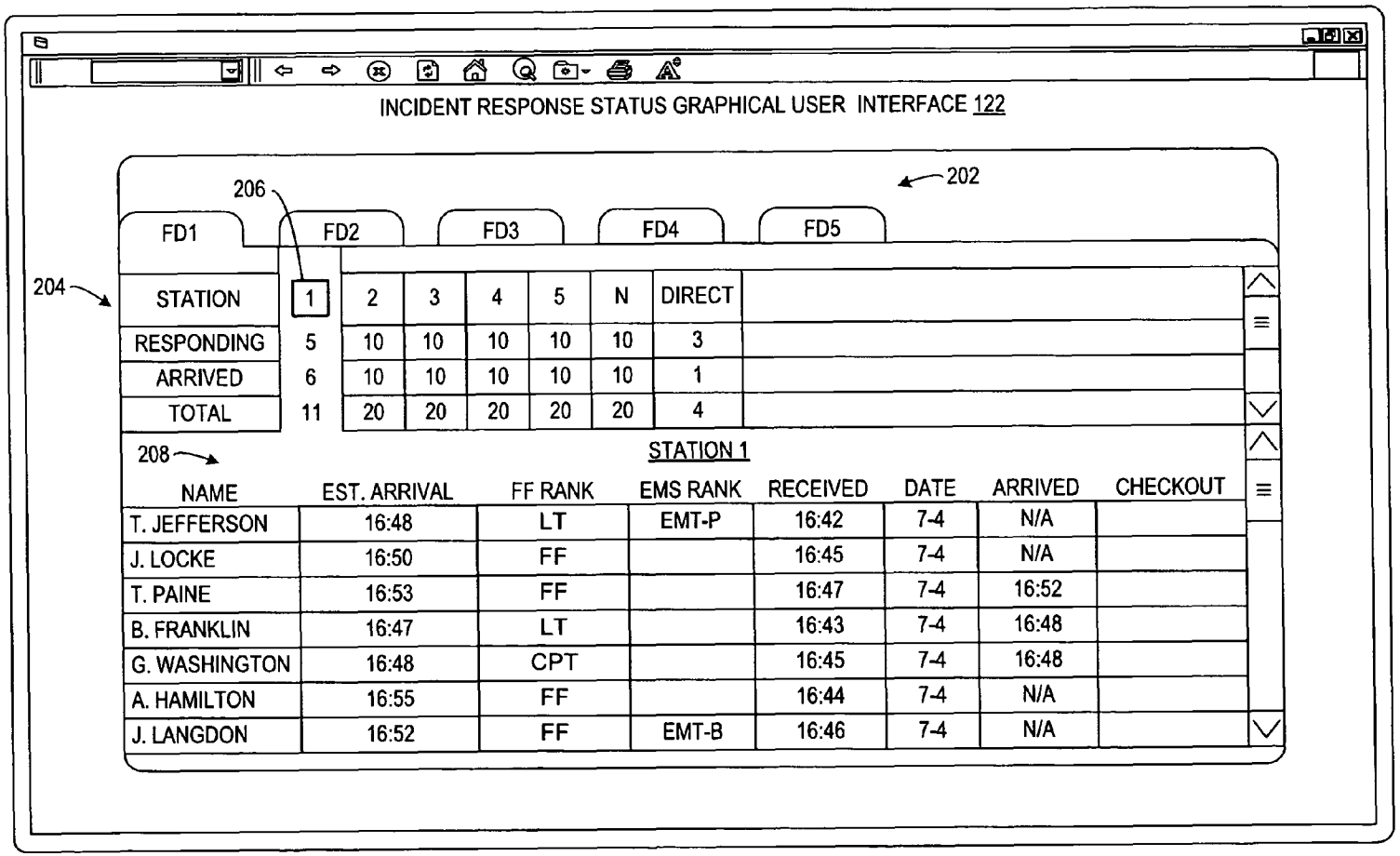

Remote incident response system 106 may be configured to compile the assessed response information generated from the communications of first responders in response-status graphic user interface (GUI) 122 (shown in FIGS. 2A-2B and referenced herein as "status GUI"). Status GUI 122 may be viewable via incident response program 120. Incident response program 120 may be configured to generate one or more incident response graphic user interfaces, for example response report GUI 124 and responder administrator GUI 126 (discussed in further detail below with reference to FIGS. 3-4). Incident response program 120 may be executable on a client device (e.g. station 1 client device 118) associated with each of response units 156 of the incident response system 100. Further, it will be appreciated that incident response program 120 may be executable on a client device associated with dispatch 102 so that the response status information may be viewed by dispatch 102. Accordingly, dispatch 102 may selectively distribute relevant information as it is updated on incident response program 120.

As used herein "program" refers to software or firmware components that may be executed or utilized by one or more computing devices of the incident response system 100, and is meant to encompass individual or groups of executable files, data files, libraries, drivers, scripts, database records, etc. It will be appreciated that incident response program 120 may be a "thin client" (e.g. a Web browser) to which application software and services are communicated via the Internet or other network from remote incident response system 106. In particular, incident response program 120 may request response status information from remote incident response system 106 via wide area network (WAN) 114. The request may be received by web server, 112 and the requested information may be retrieved by application server 110. Further, the retrieved information may be sent to the requesting incident response program via web server 112.

Note, although not explicitly shown in FIG. 1, it will be appreciated that each of response units 156 may include one or more client devices configured to execute incident response program 120. For example, fire department client device 116 may execute the incident response program to monitor the response status of each of stations 1-N (generally referenced at 118, 128, 130, and 132). Additionally, station 1 (118), station 2 (128), station 3 (130), and station N (132) may include client devices configured to execute the incident response program 120 in order to monitor the response status in real-time. Moreover, due to the modular nature of the incident response system 100, it may be appreciated that the incident response system may be expanded to include any number of participating response units which may access incident response information from the remote incident response system on a client device that is configured to execute the incident response program.

Furthermore, portable client devices configured to execute the incident response program 120 and communicate with the remote incident response system 106 may be used by various units while in transit, for example in a response apparatus to or from an incident or by a first responder that is away from a fire department/station. In one example, a direct responder may use field user client device 134 (e.g. a "smart phone", wireless personal digital assistant, wireless laptop computer) to view the response status GUI 122 in order to determine the response status of a particular station. Information provided from the remote incident response system may facilitate quick decision making of whether the direct responder should wait for additional personnel at the station or respond to the scene with an emergency apparatus. Information provided from the remote incident response system 106 may also help in making a decision to respond directly to the incident location or whether to divert to a particular fire station. As another example, a field commander (e.g. a fire chief) may use field command client device 136 (e.g. a wireless laptop computer) to view the status GUI 122 in order to determine the response status of the entire fire department. Information from the remote incident response system may facilitate a quick decision of whether the field commander should request mutual aid from a neighboring fire department or request additional help from within their department from other stations.

Note, fire departments and dispatch stations may view the response status of participating neighboring fire departments so that response support may be provided in the form of mutual aid. In one example, fire department 116 may view the response status of stations of neighboring fire department 138 and vice versa to provide suitable support for various incidents.

Since the incident response system may be "web-based" and information may be served remotely from the remote incident response system 106 to different clients, the incident response system may be scalable to different sized applications. In one example, the incident response system 100 may be scaled down for an application with budget restrictions that may limit the number of devices in-station and/or in the field. In such an application, the remote incident response system 106 may send response status information to only one or several client devices. In one particular example, response status information may be only sent to dispatch client device 102 and the dispatcher may send response status updates via radio transmissions to the various other response units. In this way, the incident response system 100 may facilitate the distribution of real-time response status information to a dispersed group of responders at a reduced cost for applications with budget restrictions.

Continuing with FIG. 1, incident response program 120 may be accessed by users of incident response system 100 via a login procedure. Further, each user of the incident response system may be provided with a unique user identification and password that may be entered during the login procedure in order to configure the incident response program to present information relevant to the unique user. User identification and password data 146 may be representative of each unique user of the incident response system 100 and may be stored in data store 144. During login by a user, user identification and password data 146 may be retrieved from data store 144 and served to incident response program 120 via the web server 112 in order to confirm the identity of the user. In some cases, only selected users may be issued a unique user identification and password. For example, in some cases, only dispatch, fire chief, battalion chief, and stations may be issued a unique user identification and password.

In some embodiments, users may be assigned different levels of security access associated with their user identification that may permit different control abilities for the incident response program. In particular, users may be assigned with user, command, and/or administrative security access levels. The user security level may permit a user to login to the system and view the status GUI 122, as well as to change the response status of users in the system. In one example, a low-ranked firefighter may have a user security level and may have access to status GUI 122. Within the status GUI, the low-ranked firefighter may change the response status of themselves or other users that are displayed.

The command security level may permit a user to view the system and may permit changes to information relating to different responders and response units as part of a response effort. For example, a high-ranked firefighter may have a command security level and may have access to status GUI 122 and report GUI 124. Report GUI 124 may present past incident response information, namely, individual and unit response statistics (report GUI 124 will be discussed in further detail below with reference to FIGS. 3A-3B). Further, the high-ranked firefighter may be permitted to change the status of other responders and responding units, such as for example, canceling the response request of a particular fire station when a suitable amount of support is responding to an incident.

The administrative security level may permit a user to view the system and may allow changes to information for the purposes of system management. For example, a firefighter administrator may have an administrative security level and may have access to responder administrator GUI 126 (discussed in further detail with reference to FIG. 4). The firefighter administrator may be permitted to change information relating to firefighters, stations, and departments. The information (i.e. department data 150, station data 152, and firefighter data 154) may be stored in data store 144.

It will be appreciated that a user of the incident response system 100 may be assigned multiple levels of security access so that they may be permitted to view different information relating to various aspects of the incident response system. For example, a user may be assigned both command and administrative security levels.

Continuing with FIG. 1, remote incident response system 106 may be accessed and maintained by system administrator 140. In some cases, system administrator 140 may be not be associated with any incident response unit, but rather may facilitate the addition of new incident response units into the system. System administrator 140 may be assigned a unique security level that permits access to system administrative GUI 142. System administrative GUI 142 (discussed in further detail below with reference to FIG. 5) may present a variety of system maintenance tools that may be used to maintain and update information in the remote incident response system 106.

FIGS. 2A and 2B show an example embodiment of incident response status GUI 122 that may be generated by incident response program 120 (shown in FIG. 1). Status GUI may present real-time response information to users of the incident response system 100 via client devices in-station, in the field, and at dispatch. Response information may be provided by the remote incident response system 106 via network communication (e.g. WAN). In particular, the response information presented by status GUI 122 may indicate the number of responders responding to the incident and the status of their response (e.g. in route or arrived). The response information may be used by various responders to make decisions on whether to respond immediately from the station or to wait for additional support to arrive. Furthermore, the response information may be used to determined whether additional support, such as for example, mutual aid from a neighboring department or from other stations within a department should be requested. In this way, a collective response effort may be efficiently carried out and response time to an incident may be reduced.

Turning now to FIG. 2A, a condensed or "slim" view of incident status GUI 122 is shown. The slim view of status GUI 122 may present an overview of the status of the response effort. In other words, the slim view of the status GUI may display the number of total responders in each response unit so that a field commander may determine whether or not additional support should be requested.

In one example, the slim view of the status GUI may be categorized by fire department and further by station. Fire department selector tabs 202 may be configured to display fire department specific response information 204 upon being selected. As shown, fire department specific response information 204 may include each of the stations in the fire department and the amount of total responders from each station. Further, fire department specific response information 204 may include a category for direct responders, or responders who travel directly to the incident and bypass the fire station. The total number of responders may be categorized as being either in the process of responding to the station (i.e. RESPONDING) or as having arrived at the station (i.e. ARRIVED). In the case of the direct responders, being categorized as arrived may indicate that the direct responder has arrived at the location of the incident. In some cases, responders who have arrived at the station may wait for a particular number of responders to arrive before leaving for the location of the incident. Accordingly, this categorization may further aid a field commander in judging how quickly the responders from a particular station may arrive at an incident.

As shown in FIG. 2B, status GUI 122 may be configured to be toggled between the "slim" view and a comprehensive view by selecting a particular station as indicated at 206. The comprehensive view of status GUI 122 includes individual first responder status information 208 in addition to fire department specific response information 204 that is shown in the condensed view. Individual first responder status information 208 may be categorized by station. Status GUI 122 may be configured to present the individual first responder information for a specific station upon selection of the specific station. For example, selecting station 1 on the status GUI would cause individual first responder information for all first responders associated with station 1 to be displayed.

Individual first responder status information 208 may provide an in-depth view of various aspects of each first responder and their response status. In the illustrated embodiment, individual first responder status information 208 may be organized into a grid where each row corresponds to a particular first responder and each column corresponds to a particular response aspect. In one example, individual first responder status information 208 may include the name of the first responder, the estimated time to arrival, the firefighter rank, the emergency medical services (EMS) rank, the time that the first responder replied to the request for response (e.g. RECEIVED), the date of the response request, time of arrival at the station (or incident location), and checkout time. In some embodiments, the individual first responder status information may include the time at which the first responder received the request to respond.

In some embodiments, the estimated time of arrival may be presented according to input provided by the first responder when reporting to the remote incident response system 106. In some embodiments, the estimated time of arrival may be calculated based on a function of the location of the responder to the station (or incident location) when the first responder reports to the remote incident response system. Further, in some embodiments, the estimated time of arrival may be calculated based on a function of one or more other suitable response aspects.

Individual first responder information 208 may include the firefighter rank and the EMS rank of each responder so that a field commander may know the leadership hierarchy and skill set of responding units. By knowing the leadership hierarchy of a response unit, the field commander may direct response communications to the appropriate responder. Further, by knowing the skill sets of the responding units, a field commander may decide whether additional support should be requested in order ensure that an appropriate amount of support in available to respond to the incident.

Individual first responder information 208 may include the time and date corresponding to when the first responder replies to the response request. Presenting the time and date of a reply to a response request may facilitate differentiating between multiple response requests. Moreover, by differentiating between different response requests, the status GUI 122 may be used as a tool to accurately account for available resources (e.g. a manpower tally tool) during response to an incident.

Individual first responder information 208 may include columns that indicate whether a responder has arrived or checked out from the fire station (or incident location). The arrival confirmation may be representative of a first responder arriving at the fire station to respond to an incident. The checkout confirmation may be representative of a responder returning to the fire station after responding to an incident. In the illustrated embodiment, an arrival/checkout confirmation may be indicated by the time that the first responder checks-in/checks-out. If a first responder has not checked-in/checked-out, the columns may display "N/A" for not applicable or the column may present nothing. Further in some embodiments, the checkout column may be omitted and instead, the status GUI may be configured to automatically remove individual first responders from the status GUI upon confirmation of checkout of the particular first responder.

In some embodiments, the rows corresponding to each responder may be color coded according to the arrival and/or checkout status of the responder. For example, a responder that has not arrived at the station may be indicated by the color red, a responder that has arrived at the station may be indicated by the color green, and a responder that has checked out may be indicated in grey (or instead may be removed from the status GUI).

It will be appreciated that additional information pertaining to the different response units and individual first responders may be presented in the status GUI 122. For example, fire station information may include what type of vehicles and equipment are available for use during the incident response. Further, it will be appreciated that although the direct responders are represented as a separate unit, in some embodiments, the direct responders may be associated with the different fire stations. Accordingly, the direct responders may be identified by a unique indicator, such as for example, a specific color code.

In some embodiments, the status GUI 122 (and other GUIs) may include selective refresh functionality which may reduce network traffic between the remote incident response system and the different client devices. For example, upon initiating the status GUI the displayed response status information may be refreshed every ten seconds for the first five minutes after initiation. After five minutes has elapsed, the status GUI may not automatically refresh the response status information, but instead may only refresh the response status information based on a request from a user client device. It will be appreciated that this is only one example of various refresh (or update) settings that may be employed to refresh the display of status GUI.

In some embodiments, the status GUI 122 (and the client device on which the status GUI is displayed) may include touch screen functionality, which may be used to navigate to different views of the status GUI and/or modify response status information presented by the status GUI. For example, upon arriving at a fire station a volunteer firefighter may change the individual response status to "ARRIVED" by physically touching the area of the screen of the client device where the row of status information for the first responder is displayed. Touching the screen of the client device may prompt the status GUI to display a change in response status confirmation or other suitable message. Additionally, it will be appreciated that the GUIs described in further detail below with reference to FIGS. 3-5 may include touch screen functionality.

Figure 3A:
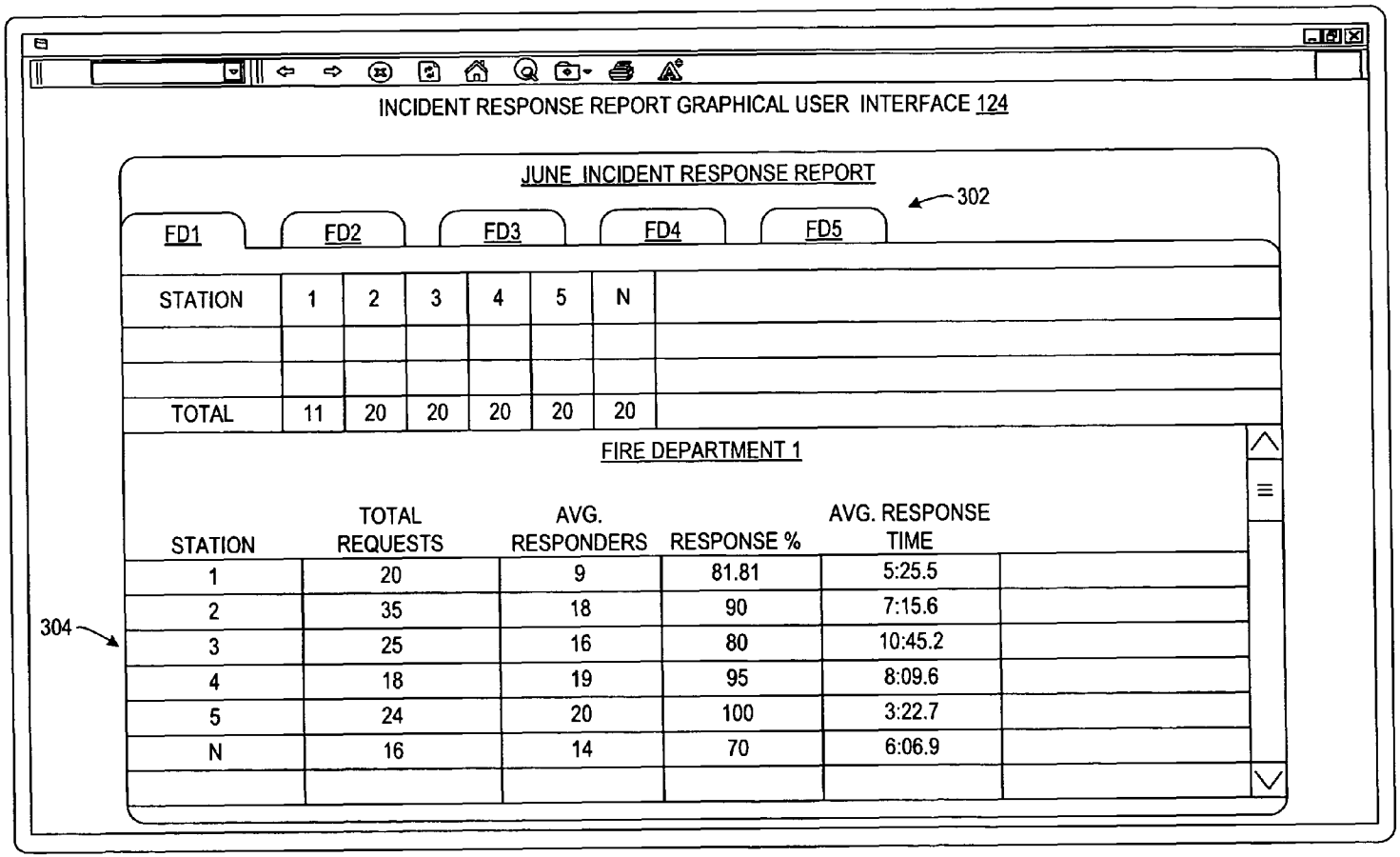
FIGS. 3A and 3B illustrate an example graphical user interface presenting an incident response report.
Figure 3B:
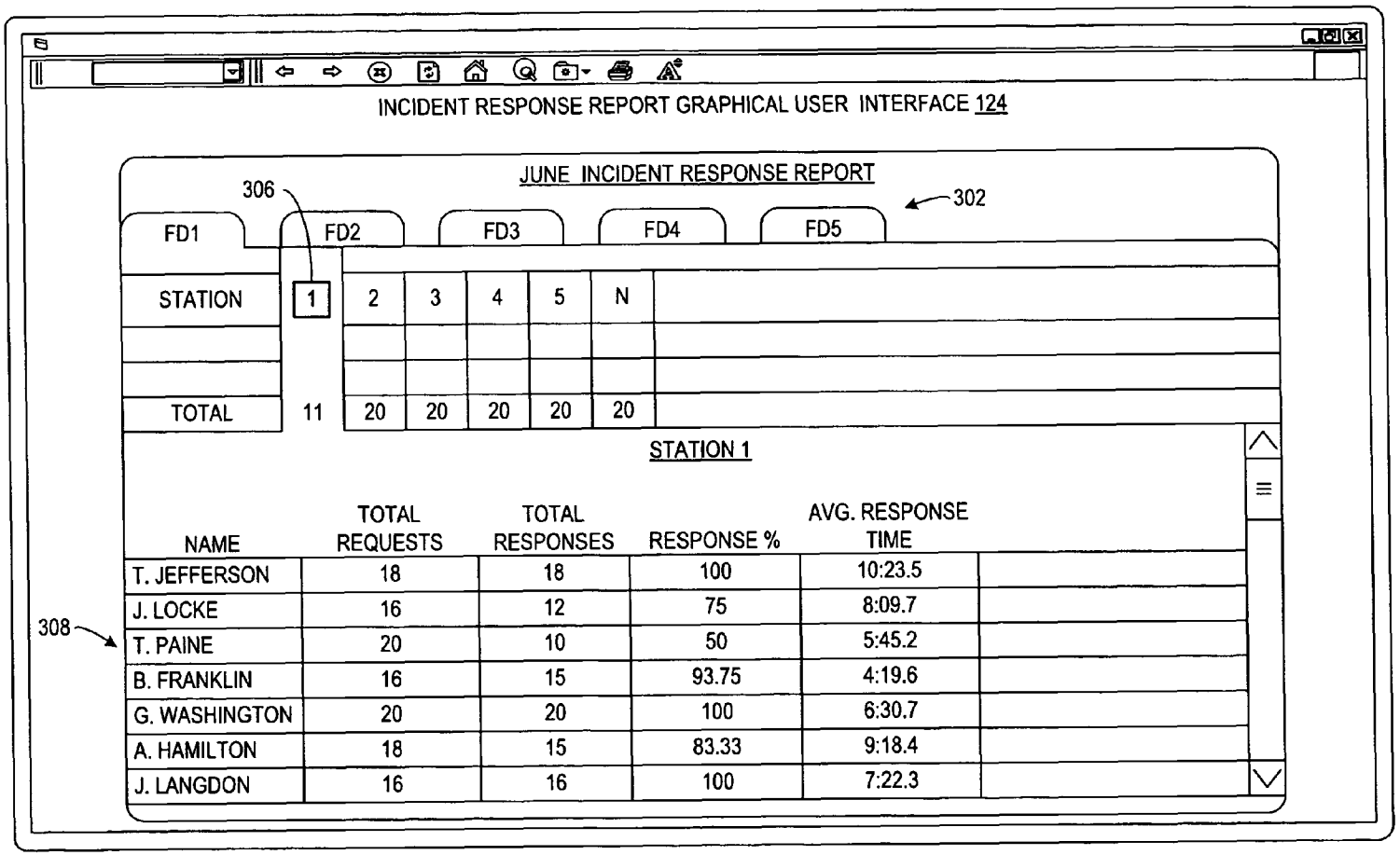

FIGS. 3A and 3B show an example embodiment of incident response report GUI 124 that may be generated by incident response program 120 (shown in FIG. 1). Report GUI 124 may present response statistics compiled based on previous incident response efforts over a predetermined period. For example, the illustrated embodiment presents statistics compiled from incident responses carried out during the month of June. Report GUI 124 may include response statistics associated with different units and response statistics associated with different individual first responders. The incident response report GUI may be used by a field commander to assess the response performance of the units and individuals. In particular, the response efforts of individuals, stations, and departments may be compared to one another so that assessments may be made and setbacks may be identified and eliminated in order to improve the response efforts of the different response units.

It will be appreciated that the incident response report may be generated on a local client device based on previously recorded response information. Alternatively, the response report may be generated by the remote incident response system and provided to a client device via network communication.

Turning now to FIG. 3A, a first view of response report GUI 124 presenting fire department response statistics is shown. Similar to the layout of status GUI 122, report GUI 124 may include fire department selector tabs 302. Each of the tabs may present fire department specific information, such as for example, the number of stations in the selected fire department, the number of individuals in each station, and response statistics associated with each station. In one example, fire station response statistics 304 may include the total number of response requests for each station, the average number of responders for each station, the percent of actual responders compared to the total number of individuals in the station, and the average response time of the station. The fire station response statistics may be used to evaluate the response performance of each station within a department.

Turning now to FIG. 3B, a second view of response report GUI 124 presenting individual response statistics is shown. Report GUI 124 may be configured to present response information associated with individuals in a station based on selection of the station within a selected fire department (as shown at 306). In one example, individual response statistics 308 may include the total number of response request for each individual, the total number of responses to the requests for each individual, the percent of total responses compared to total requests, and the average response time of each individual. The individual response statistics may be used to evaluate the response performance of each individual within a station.

It will be appreciated that the report GUI 124 may present other statistics relating to individual first responder, station, and/or department response performance without departing from the scope of the present disclosure.

Figure 4:
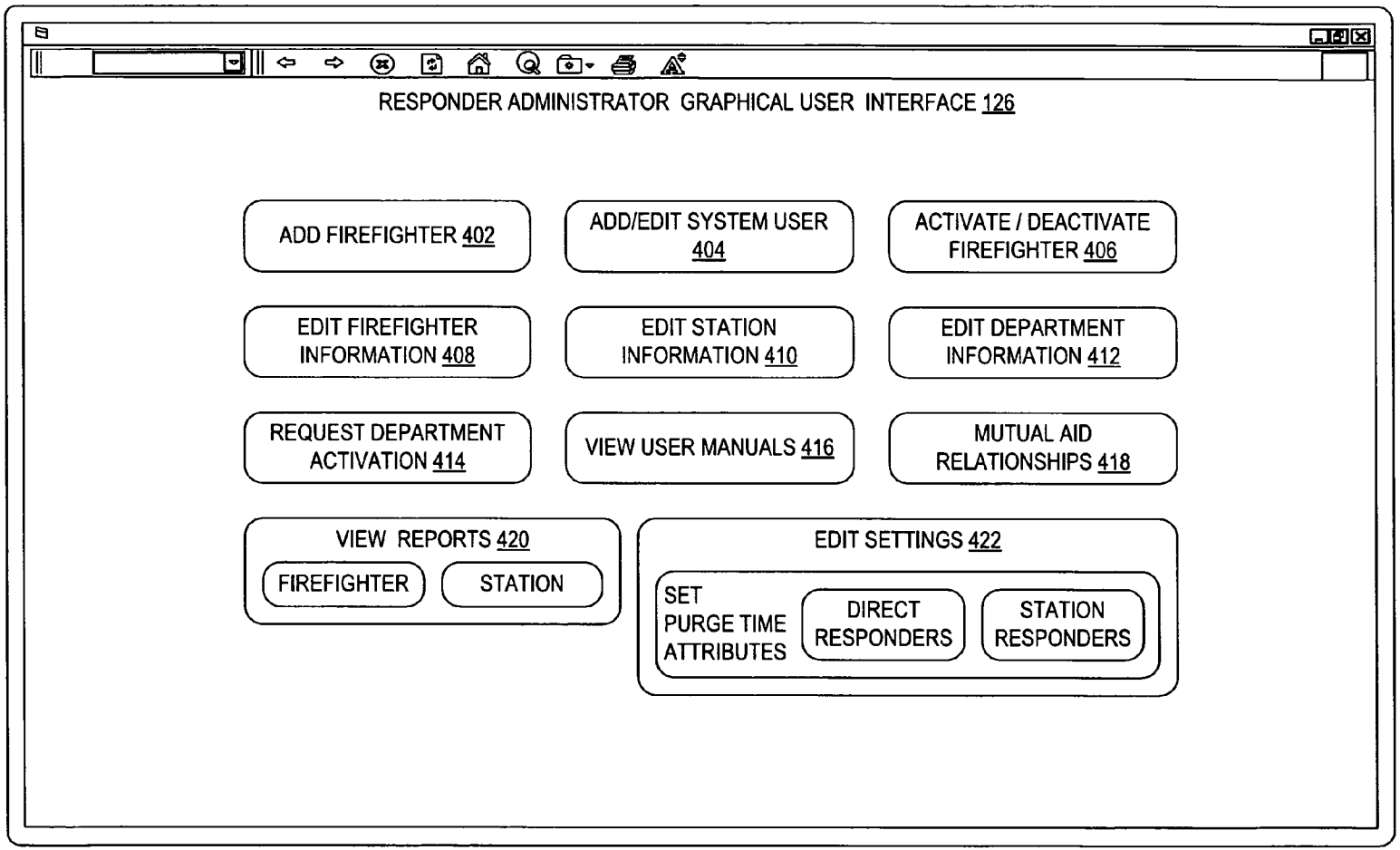
FIG. 4 illustrates an example graphical user interface presenting firefighter administrator tools.

As discussed above, some users of the incident response system 100 may be assigned an administrative security level, which may permit the user to modify performance characteristics of the system. More particularly, the administrative security level may enable a user to change various system settings, as well as to input/change information about the respective response units and individual responders of the incident response system. FIG. 4 shows an example embodiment of responder administrator GUI 126 that may be generated by incident response program 120 (shown in FIG. 1). Responder administrator GUI 126 may include add firefighter selector 402, add/edit system user selector 404, and activate/deactivate firefighter selector 406. These selectors may initiate operations to add new first responders or to change the active status of existing first responders in the incident response system 100.

For example, upon selection of add firefighter selector 402, an administrative user may be prompted to add information about the new firefighter to the incident response system. Similarly, upon selection of add/edit system user selector 404, an administrative user may be prompted to add information about the new user to the incident response system 100 or edit information already saved in the system. In one example a user may be a first responder that may not be associated with one particular fire station, but rather may be associated with multiple stations or may be a direct responder. Further, upon selection of activate/deactivate firefighter selector 406, the status of a firefighter that is entered into the system may be modified to show whether or not the firefighter is available for response service. In some embodiments, activate/deactivate firefighter selector 406 may include functions to delete a firefighter from the incident response system.

Responder administrator GUI 126 may include edit firefighter information selector 408, edit station information selector 410, and edit department selector 412, which may facilitate changes in information pertaining to the respective response units and/or first responders once the information has been entered into the incident response system. Example firefighter information may include, name, user identification, password, firefighter rank, telephone number(s), department and/or station affiliation address, etc. Example station information may include, identification number, address, members associated with the station, station resources (e.g. equipment or vehicles), telephone call-in number(s), etc. Example department information may include, identification number, region, stations associated with the department, etc.

As discussed above with reference to FIG. 1, in one example, the firefighter, station, and department data may be generated on a client device and may be sent to the remote incident response system 106 via network 114. Further, the data may be stored in data store 144 and may be accessible via remote incident response system 106.

Responder administrator GUI 126 may include request department activation selector 414 that upon selection may be configured to send a request to the incident response system administrator 140 to initiate activation of a new department in order to expand the incident response system. In some embodiments, request department activation selector 414 may be used to request station activation. In some embodiments, the responder administrator GUI 126 may include a selector that may add a new station to an existing department. Accordingly, expansion of an existing department may be conducted by a member of the department.

Responder administrator GUI 126 may include view user manuals selector 416 that upon selection may present operating instructions for the incident response program 120. In one example, operating instructions may include, how to access the program, how to edit information, how to change system settings, etc.

Responder administrator GUI 126 may include mutual aid relationships selector 418 that upon selection may present modifiable relationships between different stations and departments. The mutual aid relationships may define a support hierarchy that may be followed when requesting response aid from other departments and/or stations.

Responder administrator GUI 126 may include view incident reports selector 420 that upon selection may present a firefighter or station view of report GUI 124 (shown in FIGS. 3A-3B). As discussed above, the report GUI may present response statistics of varying levels of response efforts over a period of time. For example, the presented response statistics may correspond to the response efforts of an individual first responder, or on a more global level, may correspond to the response of a station and/or department.

Responder administrator GUI 126 may include edit settings selector 422 that upon selection may facilitate a user to change the operational settings (or parameters) of the incident response program. For example, attributes of the purge time of responders presented in the status GUI 122 may be modifiable. In other words, the name and data of a responder may be removed from the status GUI a set time after a reply to a response request is received by the remote incident response system 106. Thus, a first responder that does not check-in by the allotted purge time may be automatically removed from the status GUI. Further in some embodiments, the purge time may be applied to removal of a first responder from the status GUI after check-out of the station has been acknowledged. The purge times of the direct responders and station responders may be set independently to account for differing travel times between locations. In one particular example, the purge time for a station responder may be set to one hour after a reply from the first responder is received (or after check-out has been acknowledged). It will be appreciated that the above described set purge time is one example of a modifiable setting accessible via edit setting selector 422. Further, it will be appreciated that edit settings selector 422 may include other suitable system settings that may be modified.

Figure 5:
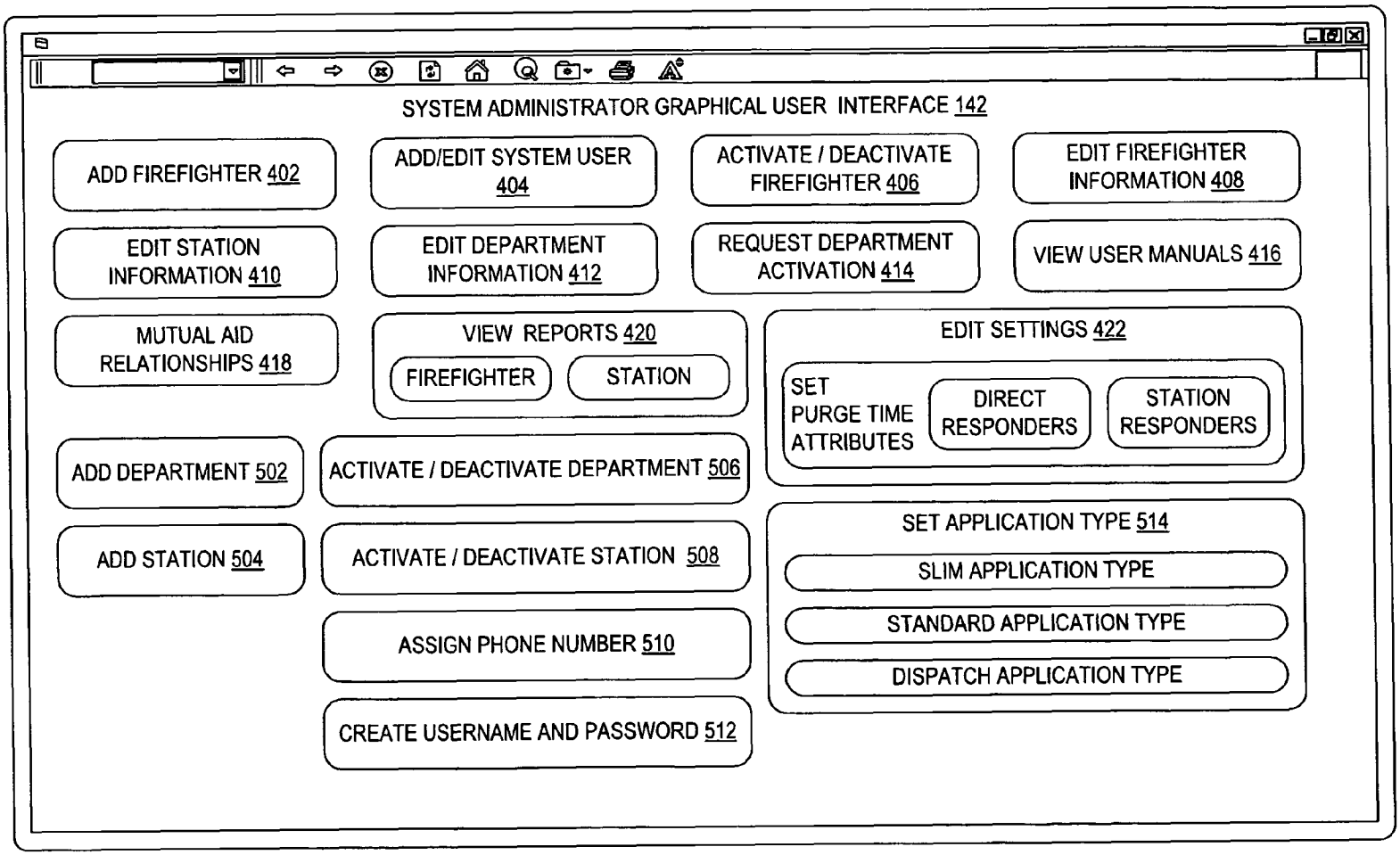
FIG. 5 illustrates an example graphical user interface presenting system administer tools.

As discussed above, the remote incident response system 106 may be managed by one or more users acting as system administrators that may be independent of any particular response unit. A user may be assigned a system administrator security level, which may permit the user to make high level modifications to the remote incident response system 106 for the purposes of expansion and maintenance. FIG. 5 shows an example embodiment of system administrator GUI 142 that may be generated by incident response program 120 (shown in FIG. 1). System administrator GUI 142 may include all (or some) of the functions and selectors included in responder administrator GUI 126 as described above. Further, system administrator GUI 142 may include add department selector 502, add station selector 504, activate/deactivate department selector 506, activate/deactivate station selector 508, assign phone number selector 510, create username and password selector 512, and set application type selector 514.

Upon selection, add new department selector 502 and add new station selector 504 may be configured to prompt the system administrator to enter information about the department or station and the information may be stored to create new departments and new stations in the remote incident response system 106. In some embodiments, selectors 502 and 504 may create blank templates for new departments and stations that may be filled in by a responder administrator. Further, upon selection, activate/deactivate department selector 506 and activate/deactivate station selector 508 may be configured to toggle the status of a department or station that has been created in the remote incident response system 106.

During the process of creating a new responder unit (e.g. department or station) in the remote incident response system 106, a system administrator may select assign phone number selector 510, which may be configured to assign a unique call-in telephone number (or unique extension) to the new responder unit. As discussed above, the call-in telephone number may be used by a first responder to direct their call when they call into the remote incident response system 106.

Set application type selector 514 may enable the system administrator to designate the configuration of the incident response program 120 that may be executed for a particular department, station, and/or dispatch. In particular, the incident response program may be set to run in a standard configuration, a slim configuration, or a dispatch configuration. For example, the standard configuration may permit all responder data to flow to and through the incident response program at the station, in the field, and at dispatch. In other words, first responders may be permitted to enter input to modify response information displayed by the incident response program (e.g. change a firefighter status). As another example, the slim configuration may permit all responder data to flow to the incident response program but not through the program. In other words, command responders (e.g. fire chief, battalion chief, etc.) may be able to view information presented by the incident response program, but no devices may be placed in stations for responding responders. In the dispatch configuration, departments may not have any devices (either command or stations) and all data may flow through dispatch, allowing dispatch to communicate the amount and status of available responder resources to command.

Figure 6:
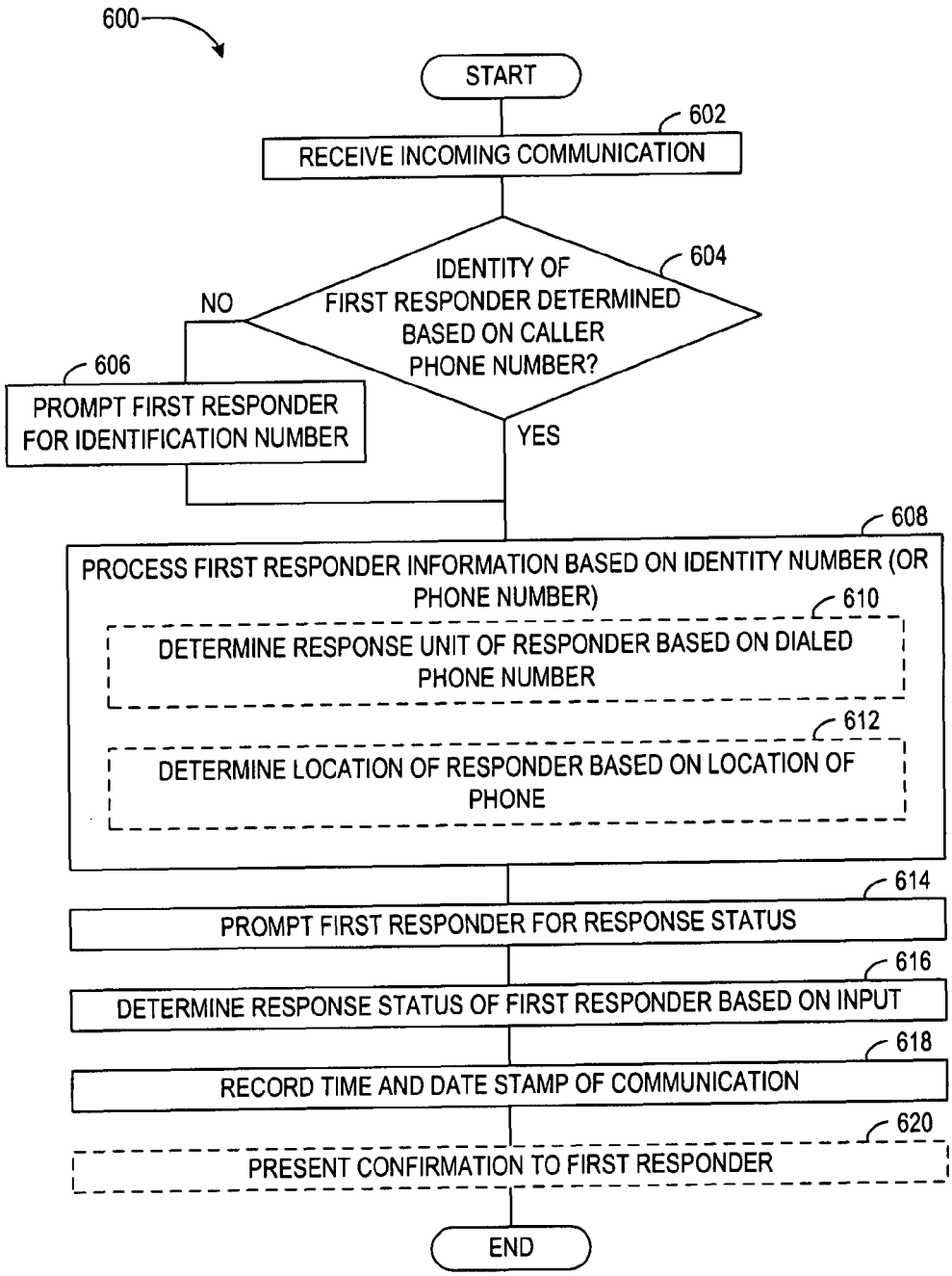
FIG. 6 depicts an example flow diagram for a method of analyzing first responder communications to identify first responder information and determine a response status of a first responder.

Turning now to FIG. 6 an example method for processing incoming first responder communications is shown at 600. Method 600 may be implemented in order to identify and classify first responders as they check-in as responding to an incident. The method may facilitate tracking of available response resources so that field commanders and other first responders may make quick decisions when responding to an incident.

Method 600 begins at 602, where an incoming communication may be received. As discussed above, a first responder may reply to a request to respond generated as a result of an incident. The first responder may reply in a variety of different manners using different devices. In one example, a first responder may send a reply communication by calling a telephone number that is assigned to a particular fire station.

Next at 604, it may be determined if the identity of the first responder is determined based on the telephone number from which the first responder is calling from. As discussed above, one or more telephone numbers may correspond to each first responder (e.g. cellular telephone number, home telephone number, work telephone number, etc.) and the telephone number(s) may be saved in the incident response system 100. In other words, the telephone number from which the call is placed may be compared to the pre-stored telephone numbers in order to identify the first responder. If the identity of the first responder is determined, the method moves to 608. Otherwise, if the identity of the first responder is not determined, the method moves to 606.

At 606, the first responder may be prompted to enter an identification number so that the first responder may be identified. In some cases, the identification number may be one of the pre-stored telephone numbers. In some cases, the identification number may be a number sequence that is unique to the first responder.

At 608, the first responder may be identified based on the telephone number (or identification number) and the first responder's response information may be processed. In some embodiments, processing the first responder's response information may include determining the particular response unit (e.g. fire station) of the first responder based on the telephone number that the first responder entered to initiate the communication at 610. In some embodiments, processing the first responder's response information may include determining the location of the first responder based on the location of the telephone (or other device) from which the communication was initiated at 612. The location of the first responder may be determined through various different manners including, for example, triangulation of signals or global positioning systems (GPS) that may be integrated into the first responder's device. Furthermore, the location of the first responder may be used to generate an estimated time of arrival of the first responder to the station (or incident location).

Next at 614, the first responder may be prompted to enter a response status. In one example, the prompt may be initiated by playing an audio file, such as for example, a .WAV file that may include human speech requesting the first responder to enter a response status.

Next at 616, the response status of the first responder may be determined based on the input of the first responder. In one example, the response status may include three different response types, responding, arrived, and checked out. The responding response status type may indicate that the first responder is in the process of reporting to the fire station or other designated location. The arrived response status type may indicate that the first responder has arrived at the fire station or other designated location. The checked out response status type may indicate that the first responder is no longer active and may be finished with responding to an incident.

At 618, the time and date of the communication may be recorded. The time and date may be included in response status information that may be displayed to determine when different first responders may arrive to the fire station or other designated location. Further, the time and date may be used for reporting purposes to assess the response performance of individual first responders.

In some embodiments, the first responder may be presented with a confirmation to communicate that the response status of the first responder has been recorded at 620. In some cases, the confirmation may be an audio message that may be played such as for example, a .WAV file. The confirmation may signal to the first responder that they may end the communication.

Method 600 may provide a standardized procedure for first responders to communicate their response status during an incident response effort. By identifying first responders that are responding to an incident as well as the response status of the first responders, available resources can be accounted for and managed efficiently and response efforts may be improved.

Figure 7:
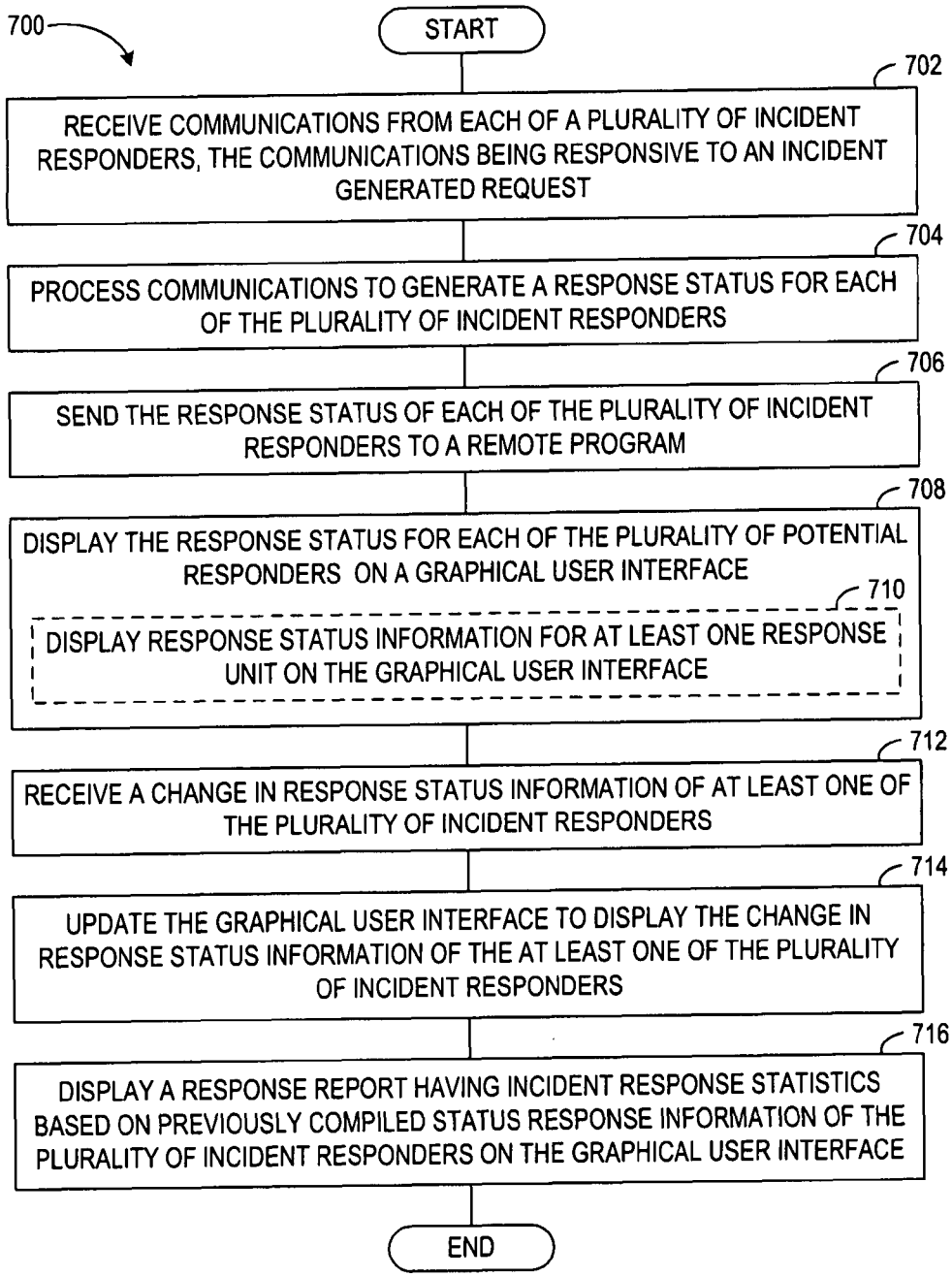
FIG. 7 depicts an example flow diagram for a method of determining response status information of a plurality of first responders and distributing the response status information.

Turning now to FIG. 7, a method of distributing response status information for a plurality of first responders is shown at 700.

Method 700 begins at 702, where a plurality of communications may be received in reply to a request to respond generated as a result of an incident. The communications may be initiated by first responders and may be directed to the remote incident response system 106. As one example, a volunteer firefighter may place a telephone call to a telephone number that corresponds to a particular fire station.

Next at 704, the communications may be processed in order to determine a response status for each of the plurality of first responders. As described above with reference to FIG. 6 and method 600, in one example, the communications initiated by the first responders may be processed by presenting the first responders with a variety of prompts and recording the input. Further, the response status for each of the plurality of first responders may be determined based on the input of the first responder.

Next at 706, the response status for each of the plurality of first responders may be sent to one or more remote programs. In particular, the remote incident response program 120 may send response status information over a network (e.g. WAN) to one or more remote programs executable on client devices. The client devices may be associated with different fire stations, fire department, dispatch, or may be associated with particular individuals or apparatuses in the field.

Next at 708, the response status for each of the plurality of first responders may be displayed on a graphical user interface generated by the remote program. In some embodiments, high-level response status information corresponding to one or more response unit(s) may be displayed on a graphical user interface as indicated at 710. In one particular example, response status information for a response unit may include the total number of first responders responding to an incident. As another example, response status information for a response unit may include what types of apparatuses (e.g. fire engine) are responding to an incident.

At 712, a change in response status information from at least one of the plurality of first responders may be received. As discussed above in one example, the response status of a first responder may be classified as responding, arrived, or checked-out. Thus, a change in response status of a first responder may be from responding to arrived. As another example, a change in response status information of a first responder may include a change from arrived to checked-out.

Next at 714, the graphical user interface may be updated to display the change in response status information of at least one of the plurality of first responders. As discussed above, in some embodiments, changes in response status type may be indicated by a change in color or other suitable reference indicia.

At 716, in some embodiments a response report may be displayed on the graphical user interface. The response report may include incident response statistics based on previously compiled status response information of the plurality of first responders. In some cases, the response report may include response statistics of individual first responders. In some cases, the response report may include response statistics of response units.

The above described method may enable a plurality of first responders to be identified quickly and accounted for so that available resources may be evaluated during a response effort. Further, compiled response status information may be sent to different locations and may be updated responsive to input from users of the incident response system 100. In this way, response status information may be generated for a plurality of first responders and may be updated in real time which may be used by a field commanders, first responders, departments, stations, dispatch, and other personnel to direct an incident response effort quickly and efficiently.

FIG. 8 depicts a schematic diagram of an example embodiment of an electronic communication device that may be used by a first responder to respond to an incident. Electronic communication device 800 (also referred to as a "hybrid tone pager device") may receive communications (e.g. requests) to respond to an incident from dispatch (or other response unit) via UHF/VHF fire tone pager receiver 808. UHF/VHF fire tone pager receiver 808 may signal controller 802 upon receiving a communication. Controller 802 may signal display 804 and/or speaker 814 to present the communication to the first responder as an audio message and/or a visual message. The first responder may respond to the request by entering user input into user input module 806. The user input may be detected by controller 802 and in response to the user input may signal wireless network interface 810 to send a communication to the remote incident response system 106 to indicate that the first responder is in fact responding to the incident. In one particular example, the electronic communication device may be a hybrid tone pager that includes a radio button that may be pushed by a volunteer firefighter to indicate that the volunteer firefighter is responding to the incident. In response to the radio button being pushed, the hybrid tone pager may send a communication via a dedicated wireless connection to the remote incident response system 106. In one particular embodiment, the hybrid tone pager device may be configured to dial only a unique phone number over a cellular network upon receiving a user input in response to a tone page.

Note that display 804 may include a liquid crystal display (LCD), light-emitting diode (LED), organic light-emitting diode (OLED), or other suitable display technology. Also, note that user input module 806 may include a keypad, touch screen, directional wheel, radio button(s), microphone, capacitive sensor, barcode scanner, accelerometer, etc. Further, electronic communication device 800 may be configured to receive user input via user input module 806 that may modify settings of the communication device. For example, user input may be entered to change the volume of the speaker. As another example, user input may be entered to change the frequency of the UHF/VHF fire tone pager receiver 808. Further, indications of the user input or setting modifications may be presented via display 804.

Furthermore, wireless network interface 810 may include various two-way network communications technologies, such as for example, a cellular modem, a two-way pager, wireless local area network (WLAN) interface, personal area network (PAN) interface (e.g. Bluetooth™), etc. Also, note that wireless network interface 810 may interface with a consumer or proprietary network including, but not limited to, a cellular network such as analog or digital cellular systems employing such protocols and designs as CDPD, CDMA, GSM, PDC, PHS, TDMA, FLEX™, ReFLEX™, iDEN™, TETRA™, DECT, DataTAC™, and Mobitex™, RAMNET™ or Ardis™ or other protocols, such as trunk radio, Microburst™, Cellemetry™, satellite, or other analogue or digital wireless networks or the control channels or portions of various networks. The networks may be proprietary or public, special purpose or broadly capable.

Continuing with FIG. 8, in some embodiments, electronic communication device 800 may include global positioning system (GPS) device 812, which may generate location data of the first responder which may be sent to controller 802. Controller 802 may include the location data in the communication sent to the remote incident response system 106. Further, the remote incident response system 100 may use the location data of the first responder to determine an estimated time of arrival of the first responder. Optionally (or alternatively), the location of the first responder may be determined via a location based system, which may employ multilateration based on the signals sent to and/or from electronic communication device 800.

In some embodiments, electronic communication device 800 may include radio-frequency identification device (RFID) 816. Each first responder may be assigned a unique identification number that may be encoded in the RFID 816. Further, RFID 816 may be configured to send a signal indicative of an identification number to a RFID receiver when in proximity to the RFID receiver. It will be appreciated that RFID receivers may be associated with (or included in) each of response units 156 (shown in FIG. 1). Thus, when a first responder comes within a proximal range of the RFID receiver, the RFID 816 may send the unique identification number of the first responder to the RFID receiver. Further, the RFID receiver may signal the remote incident response system 106 that the first responder has arrived at the particular response unit. In this way, a first responder may be automatically checked-in/checked-out, or the response status of the first responder may be automatically updated.

Electronic communication device 800 may include battery 818 to provide power to the above described communication components. However, it will be appreciated that since RFID 816 is passive, battery 818 may not provide power to RFID 816. In some embodiments, battery 818 may be rechargeable and/or replaceable. Further, electronic communication device 800 may include antenna 820, which may boost communication of at least one of UHF/VHF fire tone pager receiver 808, wireless network interface 810, and GPS 812. In some embodiments, antenna 820 may include multiple antennas, one for each communication component, for example.

It will be appreciated that in some embodiments various components of the electronic communication device as described above, may be omitted. For example, the display, GPS, and RFID may be omitted from the electronic communication device.

It will be appreciated that the configurations and routines disclosed herein are exemplary in nature, and that these specific embodiments are not to be considered in a limiting sense, because numerous variations are possible. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for identifying available resources for responding to an incident, the method comprising:

receiving a communication from each of a plurality of first responders, where the communication is responsive to an incident generated request;

processing each of the communications to generate a response status selected from at least three response status types for each of the plurality of first responders; and sending the response status for each of the plurality of first responders, response status information for each of a plurality of fire stations of a fire department, and a total number of responders for the fire department to a remote program for display on a graphical user interface generated by the remote program.

2. The method of claim 1 further comprising:

generating a display based on the response status of each of the plurality of first responders for the graphical user interface generated by the remote program, where the first responders include volunteer firefighter first responders.

3. The method of claim 2, wherein different response status types are displayed in different colors of a color code.

4. The method of claim 2, further comprising:

displaying a response report on the graphical user interface, the response report including incident response statistics based on previous response status information of the volunteer firefighter first responders of the plurality of first responders, the incident response statistics including individual volunteer firefighter first responder statistics and response unit statistics.

5. The method of claim 1 wherein the at least three response status types include responding, arrived, and checked out.

6. The method of claim 1 wherein the response status includes an estimate of an amount of time for the first responder to respond to the incident and at least one of a firefighter rank and an emergency medical services rank for the first responder.

7. The method of claim 1 wherein processing the communication includes identifying the first responder based on a telephone number from which the communication is generated.

8. The method of claim 1 wherein the communication includes at least one of a telephonic message and a text-based message.

9. The method of claim 1 wherein the remote program is executable on a client device and the response status for each of the plurality of first responders is sent to the client device via a network.

10. The method of claim 1 wherein the plurality of first responders are associated with different response units, and the response status for each of the plurality of first responders is sent to a plurality of remote programs associated with the different response units, the remote programs configured to display a graphical user interface having a view corresponding to each of the different response units and the response status for each of the plurality of first responders associated with the response units.

11. The method of claim 1 wherein the first responder is a volunteer firefighter that sends the communication via telephone, and wherein processing the communication includes identifying a telephone number from which the communication is generated in order to identify the volunteer firefighter, identifying the called telephone number to identify a fire station that the volunteer firefighter is associated with, and determining whether or not the firefighter is responding to the incident.

12. The method of claim 1 wherein at least one of the communications from the plurality of first responders is generated via a hybrid tone pager device, the communication indicating that a volunteer firefighter is responding to the incident, and the communication initiated based on user input from the volunteer firefighter.

13. A method for presenting incident response information, the method comprising:

displaying response status information for each of a plurality of fire stations of a fire department and a total number of responders for the fire department on a graphical user interface;

receiving a change in response status information of at least one of the plurality of fire stations; and updating the graphical user interface to display the change in response status information of the at least one of the plurality of fire stations and the total number of responders for the fire department.

14. The method of claim 13 further comprising:

displaying a total number of responders for each of the plurality of fire stations of the fire department.

15. The method of claim 13 further comprising:

displaying response status information for each of a plurality of responders for each of the plurality of fire stations.

16. The method of claim 13 wherein the response status information for each of the plurality of responders includes a color code where a different color corresponds to a different response status type.

17. The method of claim 15 wherein the response status information includes at least one of an estimated time of arrival, firefighter rank, emergency medical services rank, time at which a reply is received, date on which a reply is received, an arrival status, and a checkout status.

18. The method of claim 13 further comprising:

displaying a response report having incident response statistics based on previous response status information of the plurality of fire stations.

19. The method of claim 18 wherein the incident response statistics include individual responder statistics and response unit statistics.

20. The method of claim 13 wherein the change in response status information is received via telephone, and the change in response status information corresponds to an intention to respond.

21. The method of claim 13 wherein the change in response status information is received via user input into a computing device.

22. An incident response system, comprising:

a communication receiver configured to catalogue an incoming communication from each of a plurality of volunteer firefighters, each of the communications being catalogued according to a dialed telephone number; and an incident response program configured to determine a response status for each of the plurality of volunteer firefighters based on each of the communications, the incident response program having a graphical user interface configured to display the response status for each of the plurality of volunteer firefighters associated with a common dialed telephone number, and display a response report having incident response statistics based on previous response status information of the plurality of volunteer firefighters;

wherein the graphical user interface is further configured to display response status information for each of a plurality of fire stations of a fire department and a total number of responders for the fire department.

23. The incident response system of claim 22 wherein each unique telephone number corresponds to a different fire station.

24. The incident response system of claim 22, wherein the incoming communication from at least one of the plurality of volunteer firefighters is generated by at least one of a hybrid tone pager that includes a UHF/VHF receiver to receive a response request and a one-touch user input to generate the incoming communication, a radio frequency identification device that generates the incoming communication in a proximal range of the communication receiver, and a global positioning device that generates the incoming communication.

25. A method for identifying available resources for responding to an incident, the method comprising:

receiving a communication from each of a plurality of first responders, the communication being generated by at least one of a hybrid tone pager that includes a UHF/VHF receiver to receive a response request and a one-touch user input to generate the communication, a radio frequency identification device that generates the communication in a proximal range of a communication receiver, and a global positioning device that generates the communication;

processing each communication to generate response status information for each of the plurality of first responders;

sending the response status information for each of the plurality of first responders to a remote program;

displaying the response status information for each of the plurality of first responders on a graphical user interface generated by the remote program; and displaying response status information for each of a plurality of fire stations of a fire department and a total number of responders for the fire department on the graphical user interface.

* * * * *